United States Patent [19]

Dezelan

[11] Patent Number: 4,515,181

[45] Date of Patent: May 7, 1985

[54] FLOW CONTROL VALVE ASSEMBLY WTH QUICK RESPONSE

[75] Inventor: Joseph E. Dezelan, Western Springs, Ill.

[73] Assignee: Caterpillar Tractor Co., Peoria, Ill.

[21] Appl. No.: 497,985

[22] Filed: May 25, 1983

[51] Int. Cl.[3] ..... F15B 13/02

[52] U.S. Cl. ..... 137/596; 137/596.13; 60/452; 91/446

[58] Field of Search ..... 137/596, 596.13; 60/452; 91/446

[56] References Cited

U.S. PATENT DOCUMENTS

| | | | |
|---|---|---|---|
| 4,037,410 | 7/1977 | Jackson et al. | 60/445 |
| 4,058,139 | 11/1977 | Budzich | 137/596.13 |
| 4,122,865 | 10/1978 | Budzich | 137/596.13 |
| 4,139,986 | 2/1979 | Budzich | 91/446 |
| 4,194,363 | 3/1980 | Young | 60/452 |
| 4,199,005 | 4/1980 | Budzich | 137/596.13 |
| 4,222,409 | 9/1980 | Budzich | 137/596.13 |
| 4,249,569 | 2/1981 | Budzich | 137/596.13 |
| 4,253,482 | 3/1981 | Stephens | 137/117 |
| 4,293,001 | 10/1981 | Budzich | 137/596.13 |
| 4,416,304 | 11/1983 | Budzich | 137/596.13 |
| 4,437,307 | 3/1984 | Budzich | 137/596.13 |
| 4,437,388 | 3/1984 | Budzich | 137/596.13 |

*Primary Examiner*—Henry C. Yuen
*Attorney, Agent, or Firm*—J. W. Burrows

[57] ABSTRACT

A valve assembly (16) for use in a fluid system (10) includes a flow control valve (82) which controls fluid flow between a fluid inlet port (34) and a fluid supply passage (36) in response to the load requirements. A main control spool (96) is selectively movable between a neutral position and first and second actuated positions. A load sensing passage (78) communicates a load signal from an actuator (26) to the spring chamber (50) of the flow control valve (82). A drain passage (80) communicates the load sensing passage (78) with the reservoir (14) when the main control spool (96) is in the neutral position. A blocking mechanism (138) blocks the load sensing passage (78) when the main control spool (96) is in the neutral position and opens one of the inlet port (34) and the supply passage (36) to the spring chamber (50) so that the flow control spool (82) is held in an open position. Upon moving the main control spool (96) to one of its actuated positions, the drain passage is blocked from the reservoir (14) and a load pressure signal in the load sensing passage (78) moves the blocking mechanism from the blocking position to an open position and simultaneously closes the communication between the spring chamber (50) and one of the inlet port (34) and supply passage (36). This arrangement provides a system in which the actuator (26) responds more rapidly upon the main valve spool being moved to an actuated position since communication between the inlet port and supply passage is initially unrestricted.

9 Claims, 1 Drawing Figure

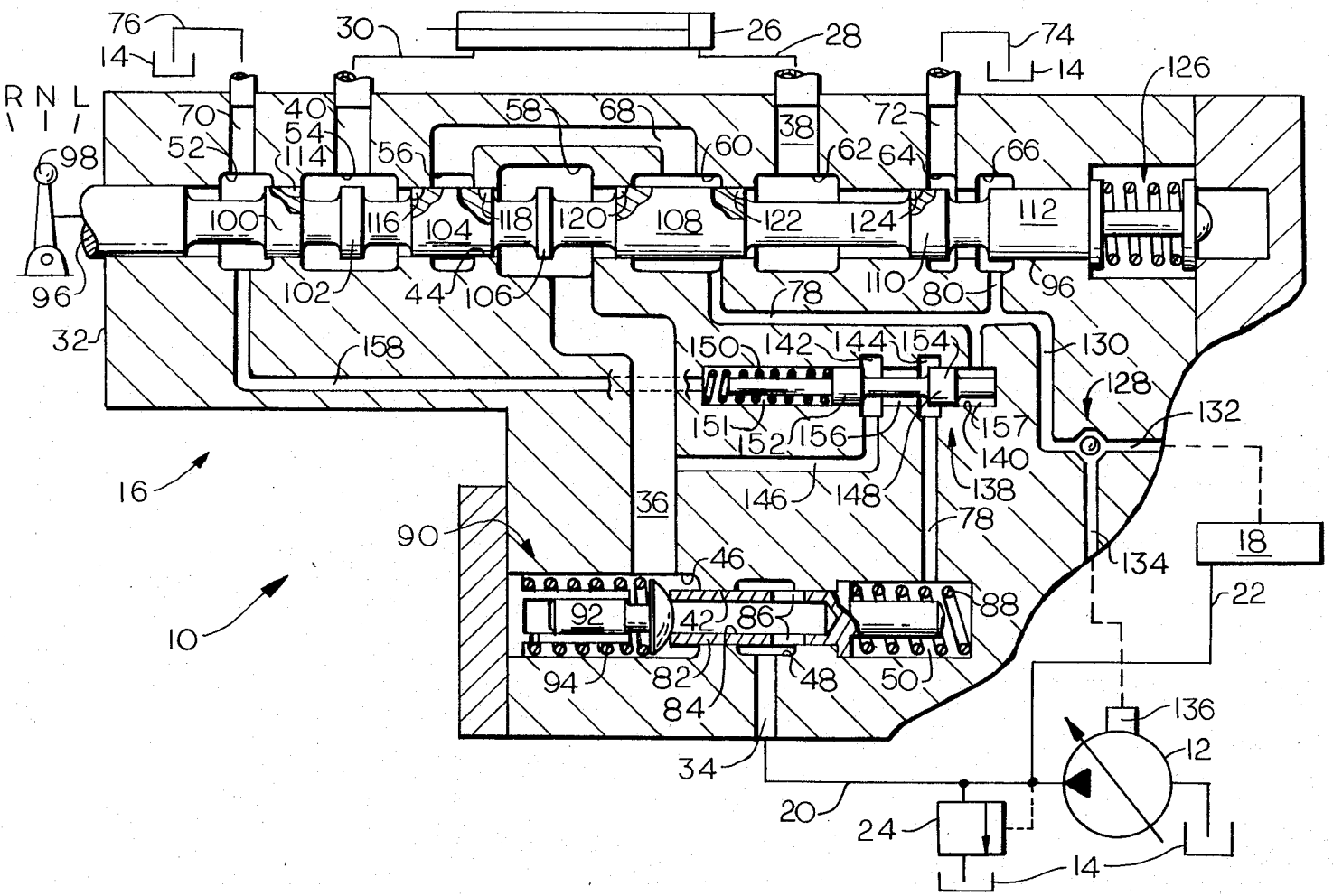
R
N
L

FLOW CONTROL VALVE ASSEMBLY WTH QUICK RESPONSE

DESCRIPTION

1. Technical Field

This invention relates generally to a flow control valve assembly and more particularly to a flow control valve assembly having means provided to make an actuator in a control system respond more rapidly to actuation of the valve assembly.

2. Background Art

Flow control valve assemblies make it possible for a system to provide flow to an actuator at a controlled rate of flow by controlling the pressure drop across the main valve spool of the flow control valve assembly. This is accomplished by having a flow control valve in the inlet flow passage control the amount of flow being directed to the main control valve. By sensing the pressure of the fluid upstream of the main spool and the pressure downstream of the main spool and applying those two pressures to the flow control valve, the rate of flow across the main spool can be controlled at a predetermined rate as is well known in the art. When the main control spool is in the neutral position, fluid flow to the actuator is cut off and with the absence of a signal pressure downstream of the main control valve the flow control spool will be moved to a position that has fluid flow substantially shut off from the main control spool. Upon operation of the main spool of the valve assembly, the fluid flow being directed across the main control valve for the given position of the main control valve will be held at a predetermined level regardless of changes in the load condition.

One of the problems encountered with such a valve assembly is that upon actuation of the main control valve to provide fluid flow to the actuator, the flow control spool must move from the closed position to an open position before any substantial amount of fluid can be directed to the actuator. This condition inhibits the actuator from responding quickly to movement of the main control spool to an actuated position by the operator.

The present invention is directed to overcoming one or more of the problems as set forth above.

DISCLOSURE OF THE INVENTION

In one aspect of the present invention a valve assembly is adapted for use in a fluid system having an actuator and a source of fluid pressure each respectively connected to the valve assembly. The valve assembly has a housing defining an inlet port, a supply passage and a work port. A valving element is located in the housing and is movable between a neutral position and an actuated position to selectively interconnect the supply passage and the work port. A flow control element is located in the housing and movable between a closed position, an infinite number of fluid metering positions and a full open position to controllably interconnect the inlet port and the supply passage. The housing defines a spring chamber at one end of the flow control element and a spring is located therein to bias the flow control element towards the full open position while the flow control element is movable towards the closed position in response to fluid pressure in the supply passage acting on the other end of the flow control element. A load sensing passage is located in the housing to communicate a load pressure signal in the work port with the spring chamber. A means is provided to block the load sensing passage between the work port and the spring chamber and to interconnect the spring chamber with one of the inlet port and supply passage in response to the load pressure signal in the load sensing passage from the work port being below a predetermined pressure level.

The present invention provides a flow control valve arrangement that is biased to the full open position when the main control spool is in a neutral or inoperative position. This overcomes the problem of the flow control element having to move to an open position before a substantial amount of fluid flow can be directed to the actuator across the main control valve. Consequently, an ample amount of fluid is available to the actuator immediately upon the main control valve being opened. Once a predetermined fluid pressure level is established in the load sensing passage, the blocking means opens the load sensing passage and the flow control valve is free to function in the usual manner.

BRIEF DESCRIPTION OF THE DRAWING

The sole FIGURE is a partial schematic of a system having a valve assembly which is shown in cross-section.

BEST MODE FOR CARRYING OUT THE INVENTION

Referring now to the drawing, a fluid control system is generally indicated by reference numeral 10 and includes a source of fluid pressure, such as a pump 12 which receives fluid from a reservoir 14 and delivers the fluid to first and second valve assemblies 16,18 through respective conduits 20,22. A relief valve 24 is connected to the conduit 20 and controls the maximum pressure level of the system in a conventional manner. An actuator 26 is connected to the valve assembly 16 by conduits 28,30.

Since the valve assemblies 16,18 are of the same general construction, the following detailed description will be directed only to the valve assembly 16.

The valve assembly 16 has a housing 32 defining an inlet port 34, a supply passage 36, and first and second work ports 38,40. A first bore 42 is defined in the housing 16 and intersects the inlet port 34 and the supply passage 36. A second bore 44 is defined in the housing 16 and intersects the supply passage 36 and the first and second work ports 38,40. Annuli 46,48 are axially spaced along the first bore 42 and intersect the first bore while a spring chamber 50 is located in the housing at one end of the first bore. A plurality of annuli 52,54,56,58,60,62,64,66 are axially spaced along and in open communication with the second bore 44.

A passage 68 is defined in the housing 32 and interconnects the annuli 56 and 60. A plurality of exhaust ports 70,72 respectively connect the annuli 52 and 64 to the reservoir 14 through conduits 74 and 76. A load sensing passage 78 is defined in the housing 16 and interconnects the annulus 60 and the spring chamber 50 while a drain passage 80 connects the load sensing passage 78 with the annulus 66.

A flow control element, such as a flow control spool 82 is slidably disposed in the first bore 42. The flow control spool 82 has an axial passage 84 located therein and opening at one end of the flow control spool 82 into the supply passage 36. A plurality of radial openings 86 are defined in the flow control spool 82 and connect the internal passage 84 with the periphery of the spool. The flow control spool 82 is movable between a full open position, an infinite number of fluid metering positions and a closed position. A spring 88 located in the spring chamber 50 biases the flow control spool 82 to the full open position.

A load check assembly 90 is located in the housing 32 and has a check member 92 that abuts the axial opening 84 of the flow control spool 82. A spring 94 biases the check member 92 into abutment with the axial opening 84 of the flow control spool 82.

A valving element, such as a main control spool 96 is slidably disposed within the second bore 44 and is movable between a neutral position, and first and second actuated positions. The main control spool 96 is selectively movable between the various positions by any suitable means, such as by a control lever 98. A plurality of lands 100,102,104,106,108,110, and 112 are axially located on the spool 96 and each being separated by a groove in a well known manner. A plurality of slots 114,116,118,120,122,124 are respectively located in lands 100,104,108 and 110. A spring centering mechanism 126 is attached to one end of the main control spool 96 and biases the spool to the neutral position.

A resolver valve 128 is located in the housing 32 and is connected to the load sensing passage 78 by a signal conduit 130 and to the second valve assembly 18 by a passage 132. A passage 134 connects the resolver 128 with a flow changing means 136 of the pump 12.

A means 138 is provided in the housing 32 for blocking the load sensing passage 78. The blocking means 138 includes a bore 140 defined in the housing 32 intersecting the signal passage 78, annuli 142,144 axially spaced along and intersecting the bore 140, and a passage 146 connecting the annulus 142 with the supply passage 36. The blocking means 138 further includes a spool 148 slidably disposed within the bore 140. The spool 148 is movable between first and second positions and is biased to the first position by a spring 150 which is located in a spring chamber 151 of the bore 140 at one end of the spool 148. Lands 152 and 154 are axially spaced on the spool 148 and are separated by a groove 156. A pressure chamber 157 is defined in the bore 140 at the other end of the spool 148. A passage 158 connects the spring chamber 151 with exhaust passage 70 through annulus 52.

Preferably the pump 12 is a flow-pressure compensated pump as is well known in the art, but it should be recognized that the pump could be of any known construction without departing from the essence of the invention. As shown in the preferred embodiment, the load check assembly 90 allows fluid flow from the flow control valve 82 to the supply passage 36 but does not allow fluid flow in the reverse direction. However, the load check valve is not required as part of the subject invention.

Industrial Applicability

In the operation of the fluid control system 10, the pump 12 delivers pressurized fluid flow to the inlet port 34 of the valve assemblies 16 and 18. Considering that the operation of the valve assemblies 16,18 are the same, only the operation of valve assembly 16 will be described.

The inlet port 34 communicates the fluid flow from the pump 12 to the flow control spool 82 through the annulus 48 of the bore 42. The flow control spool 82 is movable between a full open position at which fluid flow from the inlet port 34 is free to communicate with the supply passage 36 through the lateral openings 86, the axial bore 84, and the check member 92; an infinite number of fluid metering positions at which fluid flow from the inlet port 34 is controllably passed to the supply passage 36; and a closed position at which the fluid flow from inlet port 34 is blocked from the supply passage 36. The flow control spool 82 is biased to the full open position by the spring 88 located in the spring chamber 50 and to the other positions by the force from the pressurized fluid in the supply passage 36 acting on the end of the flow control spool 82 opposite the spring chamber 50.

The fluid flow in the supply passage 36 communicates with the main control spool 96 in the annulus 58 of the bore 44. The main control spool 96 is movable between a neutral position, and first and second actuated positions. At the neutral position of the main control spool 96, communication between the supply passage 36 and the first and second work ports 38,40 is blocked and communication between the first and second work ports 38,40 is blocked from the reservoir 14. Additionally, the load sensing passage 78 is blocked from communication with the supply passage 36 and the work ports 38,40 by the lands 104,108 of the main control spool 96 while the load sensing passage 78 is in fluid communication with the reservoir 14 through the drain passage 80, the annuli 66,64, the exhaust port 72 and the conduit 74. At the first actuated position or "R" position, the supply passage 36 is in fluid communication with the work port 38 through the slot 118 of the land 104, the annulus 56, the passage 68, the annulus 60, the slot 122 of the land 108 and the annulus 62. The fluid in the first work port 38 is directed to one end of the cylinder 26 by the conduit 28 and the fluid from the other end of the cylinder 26 is exhausted to the second work port 40 through the conduit 30. The exhaust fluid from the work port 40 is directed to the tank 14 through the annulus 54, the slot 114 of the land 100, the annulus 52, the exhaust port 70 and the conduit 76. The drain passage 80 is blocked by the land 112 such that fluid flow to the reservoir 14 cannot take place. The pressurized fluid in the annulus 60 is representative of the load in the cylinder 26 and is communicated to the pressure chamber 157, of the blocking means 138 as the load signal. The blocking means 138 as will be described more fully hereinafter controls communication of the load signal with the spring chamber 50.

At the other actuated position of the main control spool 96 or the "L" position, the fluid flow in the supply passage 36 is directed to the second work port 40 through the annulus 58, the slot 120 of the land 108, the annulus 60, the passage 68, the slot 116 of the land 104 and the annulus 54. The fluid flow in the second work port 40 is directed to the other end of the cylinder 26 through the conduit 30 while the exhaust flow from the one end of the cylinder 26 is passed to the first work port 38 through the the conduit 28. The fluid flow in the first work port 38 is directed to the reservoir 14 through the annulus 62, the slot 124 of the land 110, the annulus 64, the exhaust port 72 and the conduit 74. The drain passage 80 is blocked from communication with the reservoir 14 by the land 110 of the main control spool 96. The pressurized fluid in the annulus 60 is communicated to the pressure chamber 157 of the blocking means 138 as noted above.

The spool 148 of the blocking means 138 is biased to the first position by the spring 150 and is moved to the second position in response to the load pressure signal in the load pressure chamber 157 acting on the end of the spool 148 being above a predetermined pressure level. At the first, spring biased position of the spool 148, the upstream portion of the load sensing passage 78 is blocked from communication with the downstream portion of load sensing passage 78 by the land 154 of the spool 148. Also, fluid communication between the supply passage 36 and the spring chamber 50 is established through the passage 146, the annulus 142, the groove 146, the annulus 144 and the downstream portion of load sensing passage 78. At the second position of the spool 148 the upstream portion of the load sensing passage 78 is in fluid communication with the downstream portion of the load sensing passage 78 through the bore 140 and annulus 144 and communication between the supply passage 36 and the downstream portion of the load sensing passage 78 is blocked by the land 154 of the spool 148.

From the above description and a review of the drawing, it should be apparent that with the main control spool 96 in the neutral position there will be no load signal pressure in the upstream portion of the load sensing passage 78 and the pressure chamber 157. Conseqently, the spool 148 of the blocking means 138 will be in its spring biased position as shown which communicates pressurized fluid from the supply passage 36 to the spring chamber 50 of the flow control valve 82. The fluid pressure from the supply passage 36 acting in combination with the spring 88 is sufficient to overcome the force created by the fluid pressure in the supply passage 36 acting on the other end of the spool 82 thus maintaining the spool 82 in the open position as shown. In this open position of the flow control spool 82, actuation of the main control spool 96 results in a more rapid response of the actuator 26.

At either of the actuated positions of the main control spool 96, a load pressure signal is generated in the annulus 60 and conducted to the upstream portion of the load sensing passage 78 and the pressure chamber 157. The load pressure signal in the annulus 60 is representative of the load in the actuator 26 since the slots 116,122 respectively open to the annulus 60 prior to the slots 118,120 opening the supply passage 36 to meter fluid flow to the annulus 60. Upon the load signal pressure reaching the predetermined magnitude, the spool 148 of the blocking means 138 moves to its second position allowing the upstream portion of the load sensing passage 78 to communicate with the downstream portion of the load sensing passage 78 and the spring chamber 50 while blocking communication of the supply passage 36 with the spring chamber 50. Thus the flow control spool 82 moves to the right, as viewed in the drawing, to controllably meter fluid flow from the fluid inlet 34 to the fluid supply passage 36 in a conventional manner to control the pressure drop between the annulus 58 and the annulus 56 or 60.

The fluid flow from the pump 12 is controlled by the flow changing means 136 in response to the load pressure signal in the load sensing passage 78 which is communicated to the flow changing means 136 through the passage 130, the resolver valve 128 and the passage 134. The resolver valve 128 functions to select the higher pressure between the passage 130 and the passage 132 and direct the higher pressure to the flow changing means 136 through the passage 134.

In view of the foregoing, it is readily apparent that the structure of the valve assembly of the present invention provides an improved arrangement which allows the flow control valve to be in a full open position when the main control spool is in a neutral or blocking position and upon the main valve spool being moved to an actuated position, the flow control valve is free to return to a flow controlling function. By having the flow control valve held in the fully open position when the main control spool is in neutral, the actuator responds more rapidly upon the main valve spool being moved to an actuated position since communication between the inlet port and supply passage is initially unrestricted.

Other aspects, objects and advantages of this invention can be obtained from a study of the drawings, the disclosure and the appended claims.

I claim:

1. In a valve assembly (16) adapted for use in a fluid system (10) having an actuator (26) and a source (12) of fluid pressure each respectively connected to the valve assembly (16), said valve assembly (16) having a housing (32) defining an inlet port (34), a supply passage (36) and a work port (38,40); a valving element (96) located in the housing (32) and movable between a neutral position and an actuated position to selectively interconnect the supply passage (36) and the work port (38,40); a flow control element (82) located in the housing (32) and movable between a closed position, an infinite number of fluid metering positions and a full open position to controllably interconnect the inlet port (34) and the supply passage (36); a spring chamber (50) defined in the housing (32) at one end of the flow control element (82) with a spring (88) located therein to bias the flow control element (82) towards the full open position; said flow control element (82) being movable toward the closed position in response to fluid pressure in the supply passage (36) acting on the other end of the flow control element (82); and a load sensing passage (78) defined in the housing (32) to communicate a load pressure signal in the work port (38,40) with the spring chamber (50), the improvement comprising:

means (138) for blocking the load sensing passage (78) between the work port (38,40) and the spring chamber (50) and interconnecting the spring chamber (50) with one of the inlet port (34) and the supply passage (36) in response to the load pressure signal in the load sensing passage (78) from the work port (38,40) being below a predetermined pressure level.

2. The valve assembly (16), as set forth in claim 1, wherein the blocking means (138) includes a two position spool (148) located in the housing (32) and movable between a first position at which said one of the inlet port (34) and supply passage (36) is in fluid communication with said spring chamber (50) and the work port (38,40) is blocked from the spring chamber (50), and a second position at which said load pressure signal in the load sensing passage (78) from the work port (38,40) is in fluid communication with said spring chamber (50) and said one of the inlet port (34) and supply passage (36) is blocked from the spring chamber (50).

3. The valve assembly (16) as set forth in claim 2, wherein said two position spool (148) is biased to the first position by a spring (150) and is moved to the second position in response to the load pressure in the load sensing passage (78) from the work port (38,40) reaching said predetermined pressure level.

4. The valve assembly, as set forth in claim 1, wherein said valving element (96) is a spool selectively movable between a neutral position at which said supply passage (36) and said load sensing passage (78) are blocked from said work port (38,40) and an actuated position at which said supply passage (36) and said load sensing passage (78) are in communication with said work port (38,40).

5. The valve assembly (16) as set forth in claim 4, wherein said housing (32) has a second work port (38,40) and said spool (96) is selectively movable to a second actuated position at which said supply passage (36) and said load sensing passage (78) are in communication with said second work port (38,40).

6. The valve assembly (16) as set forth in claim 5, wherein said housing (32) has an exhaust passage (72) and said load sensing passage (78) is open to said exhaust passage (72) with the spool (96) in the neutral position.

7. The valve assembly (16) as set forth in claim 1, wherein said flow control element (82) is a spool.

8. The valve assembly (16) as set forth in claim 1, wherein said source (12) of fluid pressure includes a variable displacement pump having flow changing means (136) connected to said load sensing passage (78) and being responsive to the load pressure signal in the load sensing passage (78).

9. The valve assembly (16) as set forth in claim 8, including a second valve assembly (18) adapted to receive fluid from said variable displacement pump (12), a resolver (128) connected to the load sensing passage of each valve assembly (16,18) and adapted to select the higher load pressure signal from the load sensing passages of the first and second valve assemblies (16,18) and deliver said signal to the flow changing means (136) of the variable displacement pump (12).

* * * * *